United States Patent [19]

Miyazaki et al.

[11] Patent Number: 4,787,829

[45] Date of Patent: Nov. 29, 1988

[54] TURBOMOLECULAR PUMP

[75] Inventors: Masayuki Miyazaki; Yoshihisa Kitora; Shin Sekiya; Kiyoshi Taketoh, all of Amagasaki; Yoshiyuki Itaya, Fukuoka, all of Japan

[73] Assignee: Mitsubishi Denki Kabushiki Kaisha, Japan

[21] Appl. No.: 21,246

[22] Filed: Mar. 3, 1987

[30] Foreign Application Priority Data

May 8, 1986 [JP] Japan ..... 61-105425

[51] Int. Cl.[4] ..... F04B 17/00; F04D 29/04

[52] U.S. Cl. ..... 417/353; 417/423.4; 415/90; 415/170 R

[58] Field of Search ..... 415/90, 170 R; 417/423 C, 410, 354, 353

[56] References Cited

U.S. PATENT DOCUMENTS

| | | | |
|---|---|---|---|
| 3,168,977 | 2/1965 | Garnier et al. | 417/410 X |
| 3,399,827 | 9/1968 | Schwartzman | 415/90 X |
| 4,057,369 | 11/1977 | Isenberg et al. | 417/423 C X |
| 4,111,595 | 9/1978 | Becker et al. | 415/90 |
| 4,116,592 | 9/1978 | Cherny et al. | 417/423 C X |

FOREIGN PATENT DOCUMENTS

| | | | |
|---|---|---|---|
| 2263612 | 7/1974 | Fed. Rep. of Germany | 415/90 |
| 1439513 | 6/1976 | United Kingdom | 417/353 |

*Primary Examiner*—Robert E. Garrett
*Assistant Examiner*—Joseph M. Pitko
*Attorney, Agent, or Firm*—Leydig, Voit & Mayer

[57] ABSTRACT

A turbomolecular pump is disclosed which has reduced axial length so as to provide a small-sized pump, and which also has improved stability during high-speed operation, is simple in construction, and is able to operate at much higher speeds than prior art devices. The turbomolecular pump comprises: a cylindrical housing having a plurality of stator vanes provided on the inner peripheral surface thereof, the cylindrical housing having inlet ports and an outlet port; a rotary shaft rotatably supported on the cylindrical casing through bearings; a rotary member fixedly mounted on the rotary shaft and having a plurality of rotor vanes provided on the radially outer peripheral surface thereof, the rotor vanes being interlaced with the stator vanes in a face-to-face relation with each other so that during rotation of the rotor, the rotor and stator vanes cooperate with each other to produce a undirectional flow of a fluid from the inlet ports toward the outlet port; and an electric motor disposed in the cylindrical housing for electromagnetically driving the rotary member to rotate relative to the housing, the motor including a rotor mounted on the rotary member and a stator mounted on the housing in an axially spaced face-to-face relation with the rotor.

7 Claims, 4 Drawing Sheets

TURBOMOLECULAR PUMP

BACKGROUND OF THE INVENTION

1. Field of the Invention

The present invention relates to a turbomolecular vacuum pump particularly adapted for use with a semiconductor manufacturing apparatus for generating high vacuum.

2. Description of the Prior Art

A conventional turbomolecular vacuum pump has hitherto been known which is described in the April–June 1983 edition of "Journal of Vacuum Science Technology" in the article entitled "A new type of turbomolecular vacuum pump bearing", on pages 224 to 227. Such a pump is illustrated in FIG. 5 in a vertical cross section. In FIG, 5, the turbomolecular vacuum pump illustrated includes a plurality of rotor vanes 1 integrally formed with the radially outer periphery of a rotary member 1a in an axially spaced parallel relation with each other, and a plurality of stator vanes 2 housed in a vertically disposed cylindrical housing 3 and fixedly mounted on the inner surface of the housing 3, the stator vanes 2 being disposed in a spaced parallel relation with each other and interlaced with the annular rotor vanes 1 in a face-to-face relation with each other. The rotary member 1a is vertically disposed in the cylindrical housing 3 and integrally formed with a rotary shaft 15 which is rotatably supported at its upper end through an upper bearing *6a* in the form of a rolling element bearing such as a ball bearing by a cylindrical frame 10 which is fixedly mounted at its lower end on a base plate or end wall 9 integrally formed with or otherwise fixedly connected with the cylindrical housing 3 at its lower end. The rotary shaft 15 is also supported at its lower end by the base plate 9 through a bearing *6b* in the form of a rolling element bearing such as a ball bearing. Disposed inside the cylindrical frame 10 is an electric motor 4 for rotating the rotary shaft 15 together with the rotary member *1a*, the electric motor 4 including a stator *4a* fixedly mounted on the inner peripheral surface of the cylindrical frame 10, and a rotor *4b* disposed radially inwardly of the stator *4a* and fixedly mounted such as by shrink fitting on the outer peripheral surface of the rotary shaft 15. The base plate 9 has an outlet port *9b* formed therethrough to which a discharge pipe 7 is connected for discharging a fluid such as, for example, air in the housing 3 to the outside. The cylindrical housing 3 is integrally formed at its open end (the upper end in FIG. 5) with an annular flange 16 for mounting the turbomolecular pump to an apparatus requiring high vacuum (not shown) such as, for example, a semiconductor manufacturing apparatus. Here, it is to be noted that the rotor vanes 1 and the stator vanes 2 are appropriately configured such that during rotation of the rotor vanes 1, a unidirectional flow of air within the cylindrical housing 3 is created in a direction from an inlet opening or port *3a* in the upper end of the housing 3 toward the outlet port *9b*.

In operation, when the turbomolecular vacuum pump as contructed in the above manner and mounted at the annular flange 16 to an apparatus (not shown) requiring high-vacuum is driven to run by means of the electric motor 4, that is when the rotary member *1a*, integrally formed with the rotary shaft 15, is driven to rotate at speeds of usually several ten thousand rpm's by energizing the electric motor 4, the fluid contained in the apparatus requiring high-vacuum (not shown) is caused to discharge to the outside by way of the inlet opening *3a* in the flanged end of the housing 3, the clearances formed between the rotor vanes 1 of the rotary member *1a* and the stator vanes 2 on the inner surface of the cylindrical housing 3, the annular chamber *3b* defined in the housing 3 between the base plate 9 and the adjacent end surface of the rotary member *1a*, the outlet port *9b* in the base plate 9 and the discharge pipe 7, as indicated by broken lines *11a* and *11b* in FIG. 5, so that the pressure inside the high-vacuum requiring apparatus (not shown) is gradually reduced to create a high vacuum therein. In this connection, it is to be noted that the pressure in the turbomolecular vacuum pump gradually decreases from the outlet port *9b* side near the atmosphere toward the inlet opening *3a* side near the high-vacuum requiring apparatus.

Usually, the greater the number of rotor vanes 1, the higher the vacuum developed in the high-vacuum requiring apparatus will be. Also, as the rpm's of the rotor vanes 1 increase, the performance of the pump is enhanced so that the size and the weight thereof can be reduced accordingly.

In the above-described conventional turbomolecular vacuum pump, however, rolling element bearings such as ball bearings are employed for the bearings *6a* and *6b* so that there arise various problems such as a shortened service life due to high-speed rotation of the rotary shaft 15 and hence of the rotary member *1a*, mechanical power loss resulting from bearing functional losses, reduced rotational performance, low assemblability and the like.

In order to cope with the above-mentioned various problems, the present inventors proposed an improved turbomolecular vacuum pump which is described in a Japanese Utilitiy Model Application under Ser. No. 60-78395 (78395/1985). Such an improved pump is illustrated in FIG. 6. In this pump, a rotary shaft 15 is supported at its upper end through a touch-down bearing 14 by a cylindrical frame 10 fixedly mounted on a base plate 9, and at its lower end by the base plate 9 through a spherical-type spirally grooved bearing 12 which is disposed in an inwardly or upwardly facing recess *9a* formed in the base plate 9, the recess *9a* being filled with a lubricating oil such as one usually having a very low saturated vapour pressure which is, for example, below $10^{-11}$ Torr at normal temperatures. The construction and arrangement of this pump are substantially the same as those of the pump illustrated in FIG. 5.

Now, referring to the rotational performance of the improved turbomolecular vacuum pump, the rotary shaft 15 mounting thereon the rotary member *1a* is rotatably supported at its upper and lower ends by means of the touch-down bearing 14 and the spherical-type spirally grooved bearing 12, respectively. When the rotary shaft 15 is driven to rotate by means of the electric motor 4, it is supported by both bearings 12 and 14 at relatively low rpm ranges, but as the rpm's of the rotary shaft 15 increase to a level above several thousand rpm's, the upper end of the rotary shaft 15 is automatically released from or drawn out of engagement with the upper touch-down bearing 14 by the gyroscopic action of the rotary member 1a mounted on the upper end of the rotary shaft 15 so that it begins to rotate without contacting the touch-down bearing 14.

On the other hand, the lower end of the rotary shaft 15 is in metal-to-metal contact with the lower bearing 12 when the rotary shaft 15 is not rotated, but it comes into sliding contact with the lower bearing 12 through the intermediary of a film of lubricating oil 13 drawn into the grooves on the lower spherical spiral bearing 12 during rotation of the rotary shaft 15. Thus, when rotating, the rotary shaft 15 is supported by a fluid film provided by the lubricating oil 13.

In the past, an induction motor was generally employed as the electric motor 4 for driving the rotary member 1*a*, and such an induction motor includes a stator 4*a* and a rotor 4*b* disposed radially in a concentric relation with each other. The stator 4*a* and the rotor 4*b* are disposed inside a cylindrical support frame 10, and hence the radial dimensions of such a stator and rotor are limited by the frame 10 so that the induction motor 4 must have a relatively large axial length to produce a certain level of output power as required. As a result, the distance between the upper and lower bearings 14 and 12 is increased, thus making the center of gravity of the rotary member 1a higher or farther away from the lower bearing 12 and destabilizing the high-speed rotation of the rotary member 1*a*. Also, it is difficult to reduce the axial size of the motor 4 and hence of the entire pump. Moreover, the rotary member 4*b* was shrink fitted onto the rotary shaft 15 so that the rotor 4*b*, being subject to centrifugal forces which increase in accordance with increases in rpm's of the motor 4, is forced to expand radially under the action of those centrifugal forces. As a result, the mechanical connection of the rotor 4*b* with the rotary shaft 15 became less secure and insufficient during the high speed operation of such an induction motor. Accordingly, there were restraints on high-speed operation of turbomolecular pumps. In addition, due to the fact that the cylindrical frame 10 is disposed radially outwardly of the rotary shaft 15 and fixedly mounted on the base plate 9 with the motor stator 4*a* secured to the inner peripheral surface thereof, the construction and assembly of the entire device was relatively complicated and inefficient.

SUMMARY OF THE INVENTION

In view of the above, the present invention is intended to obviate the above-described problems of the prior art, and has for its object the provision of a novel and improved turbomolecular pump which is reduced in its axial length so as to provide a small-sized pump, which has improved stability during high-speed operation, which is simple in construction, and which is able to operate at much higher speeds than prior art devices.

In order to achieve the above object, according to the present invention, there is provided a turbomolecular pump which comprises:

a cylindrical housing having a plurality of stator vanes provided on the inner peripheral surface thereof, the cylindrical housing having inlet port means and outlet port means;

a rotary shaft rotatably supported on the cylindrical casing through bearing means;

a rotary member fixedly mounted on the rotary shaft and having a plurality of rotor vanes provided on the radially outer peripheral surface thereof, the rotor vanes being interlaced with the stator vanes in a face-to-face relation with each other so that during rotation of the rotor, the rotor and stator vanes cooperate with each other to produce a unidirectional flow of a fluid from the inlet port means toward the outlet port means; and an electric motor disposed in the cylindrical housing for electromagnetically driving the rotary memeber to rotate relative to the housing, the motor including a rotor mounted on the rotary member and a stator mounted on the housing in an axially spaced face-to-face relation with the rotor.

It is preferable that the rotor comprise an annular disc-like member fixedly secured at its one side surface to one end surface of the rotary member and having a first operating surface formed at its other side, and that the stator have a second operating surface disposed in a face-to-face relation with the first operating surface of the rotor, the first and second operating surfaces being disposed substantially perpendicular to the axis of the rotary shaft.

The cylindrical housing is disposed in a vertical manner with the rotary member and the rotary shaft being disposed vertically, and the bearing means comprises an upper bearing and a lower bearing adapted to rotatably support the upper and lower ends of the rotary shaft, respectively.

Preferably, the upper bearing comprises a touch-down bearing mounted on the upper end wall of the cylindrical housing.

Preferably, the lower bearing comprises a spherical-type spirally grooved bearing mounted at the lower end wall of the cylindrical housing.

The upper bearing may further comprise a magnetic bearing adapted to magnetically suppress radial oscillations of the rotary shaft.

Preferably, the magnetic bearing comprises a reaction-type magnetic bearing.

The rotary member has an annualr recess formed at one side surface thereof at a location near the center thereof so as to surround the rotary shaft, the motor being disposed in the annular recess.

It is preferable that the housing have an annular projection extending axially inwardly from one end wall of the cylindrical housing in concentric relation with the rotary shaft, the stator of the motor being mounted on the annular projection, the rotary shaft extending from one end surface of the rotary member into the hollow interior of the annular projection.

The above and other objects, features and advantages of the present invention will become more apparent from the following detailed description of a few preferred embodiments of the invention when taken in conjunction with the accompanying drawings.

BRIEF DESCRIPTION OF THE DRAWINGS

FIGS. 1 and 2 show a turbomolecular pump in accordance with one embodiment of the present invention in which;

FIG. 1 is a plan view of the same; and

FIG. 2 is a vertical cross sectional view of the same.

FIGS. 3 and 4 show a turbomolecular pump in accordance with another embodiment of the present invention in which;

FIG. 3 is a plan view of the same; and

FIG. 4 is a vertical cross sectional view of the same.

DESCRIPTION OF THE PREFERRED EMBODIMENTS

Figure 1:
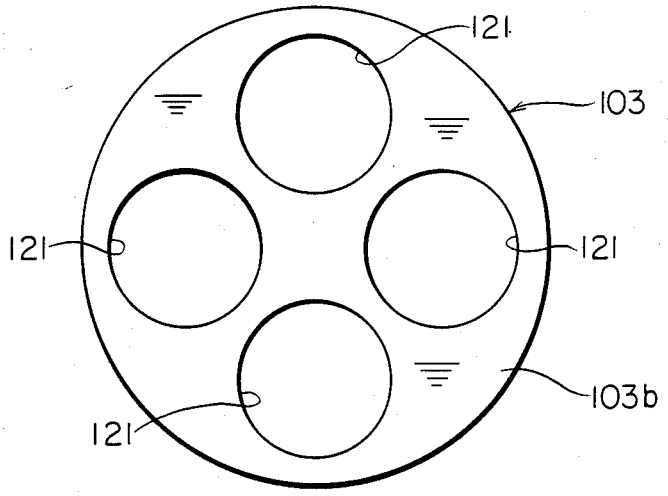

The present invention will now be described in detail with reference to a few presently preferred embodiments thereof as illustrated in the drawings. In the following, the same or corresponding parts or elements in the embodiments are identified by the same reference numerals as employed in FIGS. 5 and 6.

Figure 2:
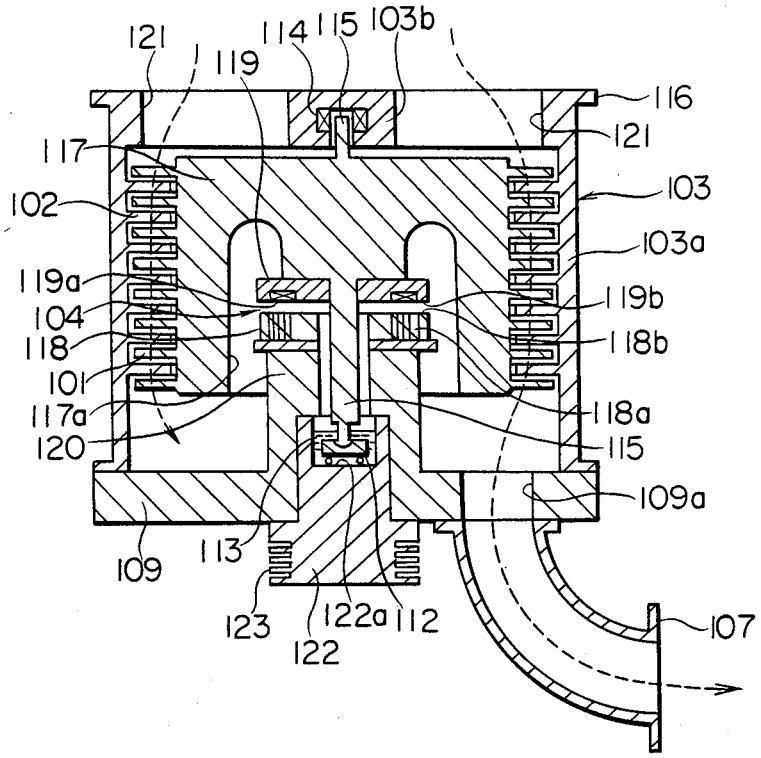

Referring first to FIGS. 1 and 2, there is illustrated a turbomolecular pump constructed in accordance with one embodiment of the present invention. In these figures, the turbomolecular pump illustrated includes a cylindrical housing, generally designated by reference numeral 103, which has a hollow cylindrical member 103*a*, an upper end wall 103*b* integrally formed with or otherwise connected with the upper end of the cylindrical member 103*a* with a plurality (four in the illustrated embodiment) of apertures or inlet ports 121 formed therethrough, and a base plate or lower end wall 109 secured to the lower end of the cylindrical member 103*a* for vertically supporting the cylindrical member 103*a*.

Disposed in the cylindrical housing 103 is a rotary member 117 having a plurality of rotor vanes 101 integrally formed with an extending radially outward from the radially outer periphery thereof, and a plurality of stator vanes 102 are integrally formed with or fixedly mounted on and extend radially inward from the inner surface of the housing 103, the stator vanes 102 being interlaced with the rotor vanes 101 in a face-to-face relation with each other.

The rotary member 117 is firmly mounted on or integrally formed with a rotary shaft 115 which extends vertically from the upper and lower end surfaces of the rotary member 117. The rotary shaft 115 is rotatably supported at its upper end at the upper end wall 103*b* of the housing 103 through a touch-down bearing 114 in the form of a roller bearing, and at its lower end on the base plate 109 through a bearing 112 in the form of a spherical-type spirally grooved bearing. The bearing 112 is disposed in an inwardly or upwardly facing recess 122*a* formed on the upper end of a cylindrical bearing box 122 which is mounted on the base plate 103, the recess 122*a* being filled with a lubricating oil 113 such as one usually having a very low saturated vapour pressure which is, for example, below $10^{-11}$ Torr at normal temperatures. The bearing box 122 has a plurality of annular cooling fins 123 integrally formed at the cylindrical outer peripheral surface of the lower portion thereof.

The base plate 109 is integrally formed at its central portion with an inwardly or upwardly extending cylindrical projection 120 into which the lower portion of the rotary shaft 115 extends downward from the lower end surface of the pump rotary member 117. The upper end portion of the cylindrical projection 120 is disposed in a cylindrical recess 117*a* defined in the lower end surface of the pump rotary member 117.

Disposed in the cylindrical recess 117*a* in the housing 103 is an electric motor 104 which is comprised of an annular stator 118 having a winding 118*a* and fixedly mounted on the upper end of the cylindrical projection 120, and an annular rotor 119 fixedly mounted on the central lower surface of the rotary member 117 and having an annular permanent magnet 119*a* embedded in the lower surface 119*b* thereof. The lower operating surface 119*a* of the rotor 119 is disposed in a vertically spaced face-to-face relation with the upper operating surface 118*b* of the stator 118. In general, a synchronized electric motor is employed for the electric motor 104.

The cylindrical housing 103 is integrally formed at the top wall 103*b* with an annular mounting flange 116. The base plate 109 has a discharge port 109*a* formed therethrough to which a discharge pipe 107 is connected for communicating a chamber, defined in the cylindrical housing 103 between the base plate 109 and the adjacent lower end surface of the pump rotary member 117, with the outside via the discharge port 109*a* and the discharge pipe 107.

Figure 5:
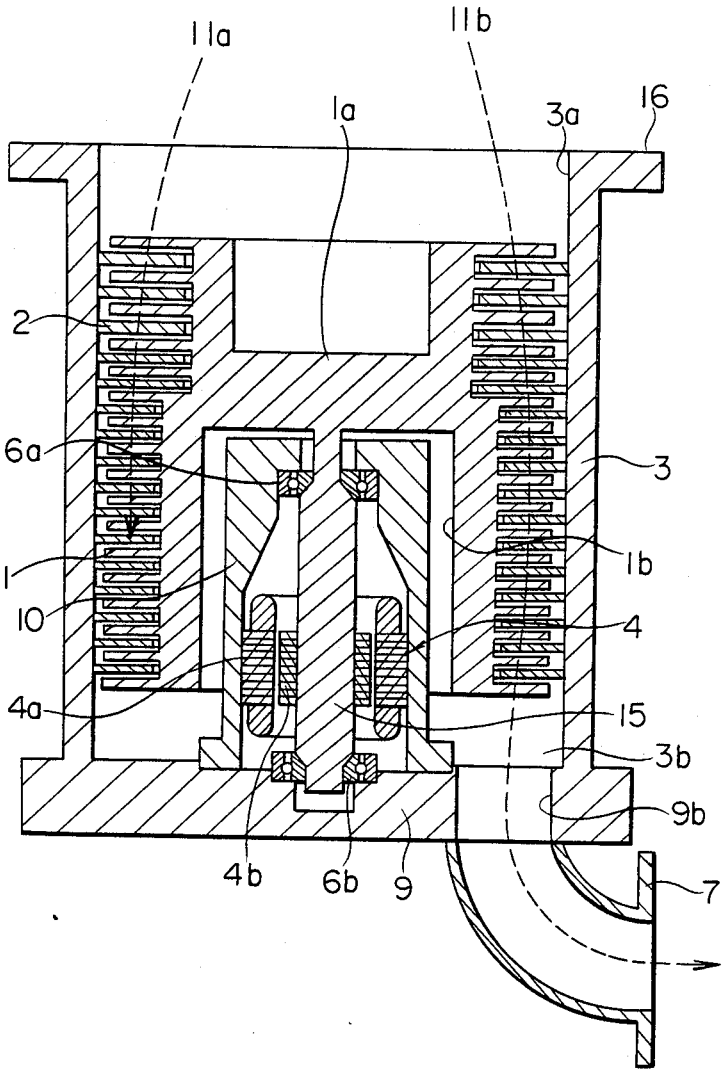
FIG. 5 PRIOR ART
FIG. 5 is a vertical cross sectional view of a conventional turbomolecular pump.
Figure 6:
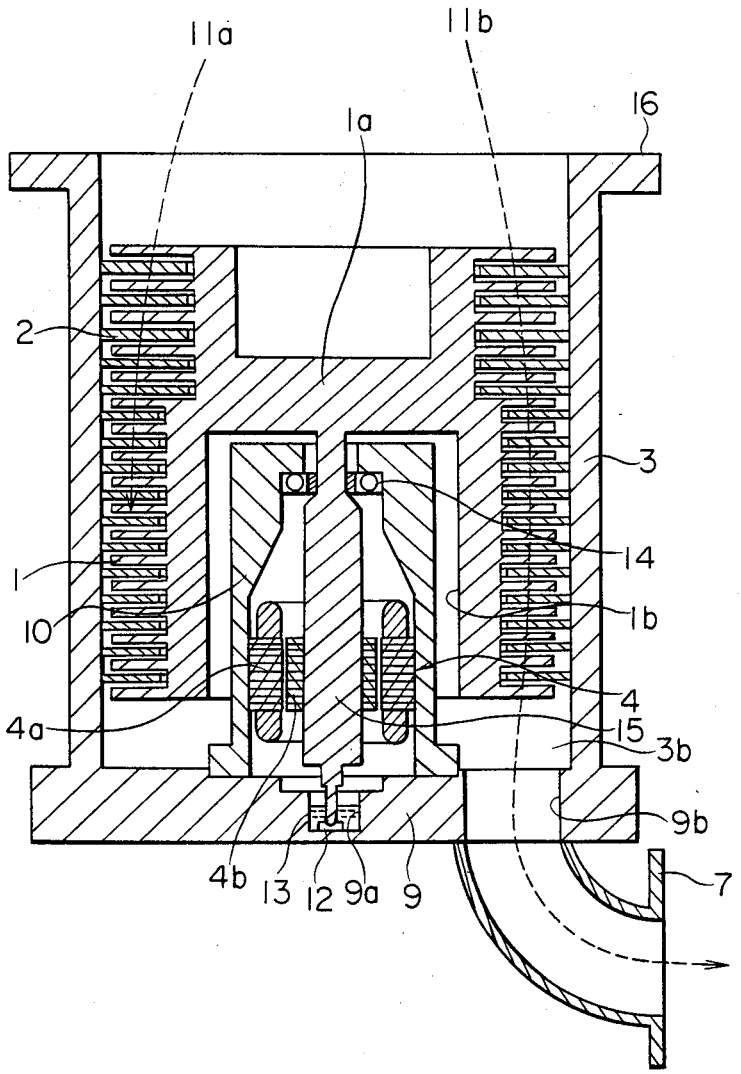
FIG. 6 PRIOR ART
FIG. 6 is a vertical cross sectional view of another conventional turbomolecular pump.

In operation, when the electric motor 104 is energized, the rotor 119 is caused to rotate relative to the stator 118 under the action of electrmagnetic forces created therebetween whereby the rotary member 117 connected with the rotor 119 is forced to rotate, thereby generating a unidirectional flow of a gaseous medium from the inlet ports 121 in the housing upper end wall 103*b* toward the outlet port 109*a* in the base plate 109, as indicated by broken lines in FIG. 2, by means of the rotor vanes 101 and the stator vanes 102. Thus, a high vacuum can be developed in an apparatus (not shown) which is to be mounted on the mounting flange 116 of the housing upper end wall 103*b*. With the above construction and arrangement in which there is employed no cylindrical support frame such as the member 10 of the prior art pumps shown in FIG. 5 or 6, it becomes possible to use a flat-type electric motor such as that shown by 104 which has the stator 118 and rotor 119 disposed vertically with their operating surfaces 118*b* and 119*b* disposed perpendicular to the axis of the rotary shaft 115 in a vertically spaced face-to-face relationship. Consequently, the use of the flat- or axial-type electric motor 104, having a reduced axial length as compared with that of the conventional motor 4 having the stator 4*a* and the rotor 4*b* disposed radially as shown in FIG. 5 or 6, serves to miminize the axial size or dimensions of the entire pump in comparison with conventional pumps. On the other hand, the radial size or dimensions of the flat- or axial-type motor 104 must generally be greater than that of conventional radial-type motors 4 as in FIG. 5 or 6 in order to produce the same level of output power. In this connection, however, it is to be noted that to provide a high fluid-drawing or suction performance, the rotor vanes 101 must rotate relative to the stator vanes 102 at a considerably high rotational speed. Therefore, to achieve such a high rotational speed, the rotor vanes 101 and the stator vanes 102 need have substantially large radial dimensions, as a consequence of which there is no problem at all if the radial dimensions of the rotor 118 and the stator 119 of the motor 104 are increased to a certain extent. In any event, it is great advantages to reduce the axial size of the entire pump.

In the above-described embodiment, the stator 118 and the rotor 119 of the electric motor 104 are mounted on the cylindrical projection 120 and the pump rotary member 117, respectively, so that upon assembly of the entire device, the cylindrical member 103*a*, having the pump rotary member 117 received therein with the rotor vanes 101 and the stator vanes 102 interlaced with each other, can be readily mounted on the base plate 109 with the lower portion of the rotary shaft 115 being inserted into the cylindrical projection 120 which has the stator 118 fixedly mounted thereon. Thus, assembly of the device is greatly facilitated as compared with the prior art apparatus as illustrated in FIG. 5 or 6 wherein the stator 4*a* and rotor 4*b* of the electric motor 4 are disposed inside the cylindrical support member 10 which is mounted on the base plate 9.

Also, when the motor rotor 119 is subjected to large centrifugal forces, there will be no fear of the motor rotor 119 becoming disconnected from the pump rotary member 117 since the rotor 119 is firmly secured at its upper surface to the central lower surface of the rotary member 117. As a result, it becomes possible to increase the rotational speeds of the pump rotary member 117 to far more than that in the conventional turbomolecular pumps shown in FIG. 5 or 6. This serves to substantially improve the performance of turbomolecular pumps as required. Thus, the number and/or radial length of the rotor and stator vanes 101 and 102 can be reduced to minimize the size or dimensions of the entire pump as compared with conventional pumps as long as the effective volume of the pump is equal to that of the conventional pump.

As for the rotational performance, the pump rotary member 117 is supported at its opposite ends by both the touch-down bearing 114 and the spirally grooved spherical bearing 112 at low rpm ranges, similar to the conventional turbomolecular pump in FIG. 6, but on the other hand, oscillations in the pump rotary member 117 are suppressed as the rotational speed of the rotary member 117 increases toward higher speed ranges so that the upper end of the rotary shaft 115 comes out of contacting engagement with the upper touch-down bearing 114 leaving the rotary shaft 115 supported only by the lower spherical bearing 112. Accordingly, the service life of the bearings is increased and mechanical power loss is reduced so as to improve the rotational performance of the pump as compared with the conventional pump illustrated in FIG. 5.

Figure 3:
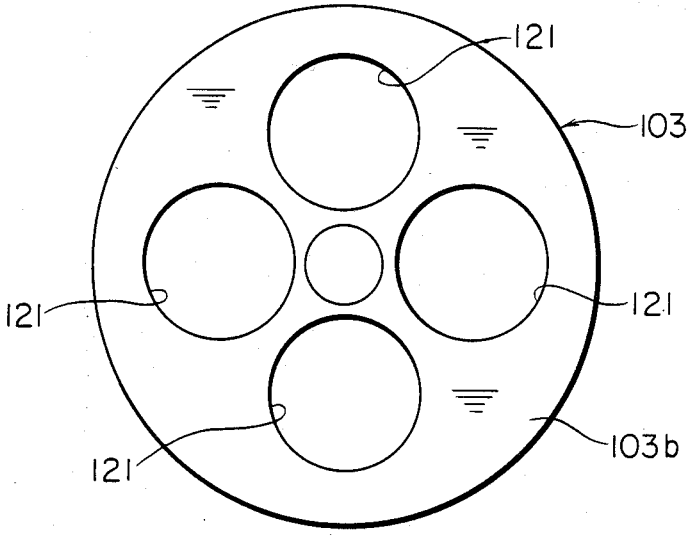
Figure 4:
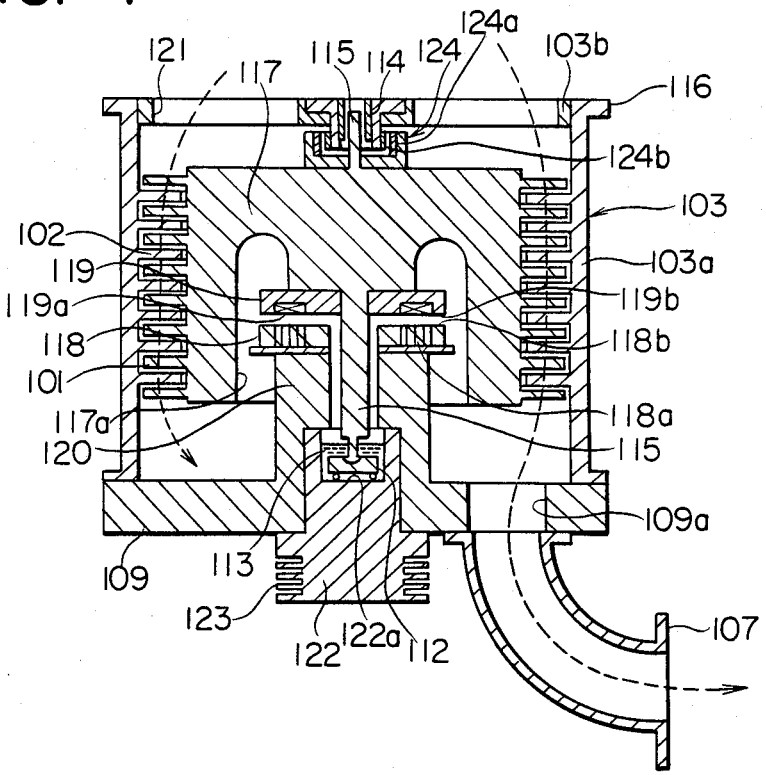

FIGS. 3 and 4 show another embodiment of the present invention which differs from the above-mentioned embodiment as illustrated in FIGS. 1 and 2 in that in addition to the touch-down bearing 114, there is provided a reaction-type radial bearing 124 such as a reaction-type magnetic bearing including a first annular permanent magnet **124*a* firmly secured to the inner surface of a bearing case mounted on the upper surface of the pump rotary member 117, and a second annular permanent magnet 124*b* secured to the outer surface of the annular bracket mounted on the upper end wall 103*b* of the pump housing 103, the second annular permanent magnet 124*b* being disposed inside the first annular permanent magnet 124*a* in a spaced concentric relation therewith. With this reaction-type non-contact bearing 124, it is possible not only to prevent radial oscillations of the pump rotary member 117 but also to hold the axis of the pump rotary member 117 at the center of rotation thereof. As a consequence, the turbomolecular pump of this embodiment has excellent rotational performance superior to that of the conventional one as shown in FIG. 6**.

While a few presently preferred embodiments of the invention have been shown and described herein, it will be apparent to those skilled in the art that various changes and modifications may be made without departing from the spirit and scope of the invention defined in the appended claims.

What is claimed is:

1. A turbomolecular pump comprising:

a cylindrical housing having a plurality of stator vanes provided on the inner peripheral surface thereof, said cylindrical housing having inlet port means and outlet port means;

a rotary shaft having an upper end and a lower end and vertically supported on said cylindrical housing for rotation about a vertical axis;

an upper bearing rotatably supporting an upper end of said rotary shaft;

a lower bearing rotatably receiving said lower end of said rotary shaft and supporting said rotary shaft within said housing in a vertical position between said upper and lower bearings;

a rotary member fixedly mounted on said rotary shaft and having a plurality of rotor vanes provided on the radially outer peripheral surface thereof, said rotor vanes being interlaced with said stator vanes in face-to-face relation with each other so that during rotation of said rotary member, said rotor and stator vanes cooperate with each other to produce a undirectional flow of a fluid from said inlet port means toward said outlet port means; and an electric motor including a stator and a rotor disposed in said cylindrical housing about said axis and in a position which is radially inward of some of the vanes for electromagnetically driving said rotary member to rotate relative to said housing, said rotor comprising an annular disc-like member fixedly secured at its one side surface to one end surface of said rotary member and having a first operating surface formed at its other side, and said stator being mounted on said housing and having a second operating surface disposed in an axially face-to-face relation with said first operating surface of said motor, said first and second operating surfaces being disposed substantially perpendicular to said axis of said rotary shaft and being located within said housing between said upper and lower bearings.

2. A turbomolecular pump comprising:

a cylindrical housing having a plurality of stator vanes provided on the inner peripheral surface thereof, said cylindrical housing having inlet port means and outlet port means;

a rotary shaft supported on said cylindrical housing for rotation about a vertical axis;

an upper bearing and a lower bearing, said upper bearing including a touch-down bearing mounted at an upper end wall of said cylindrical housing;

a rotary member fixedly mounted on said rotary shaft and having a plurality of rotor vanes provided on the radially outer peripheral surface thereof, said rotor vanes being interlaced with said stator vanes in face-to-face relation with each other so that during rotation of said rotary member, said rotor and stator vanes cooperate with each other to produce a unidirectional flow of a fluid from said inlet port means toward said outlet port means; and an electric motor including a stator and a rotor disposed in said rotary member, said rotor and stator vanes cooperate with each other to produce a unidirectional flow of a fluid from said inlet port means toward said outlet port means; and an electric motor including a stator and a rotor disposed in said cylindrical housing about said axis and in a position which is radially inward of some of the vanes for electromagnetically driving said rotary member to rotate relative to said housing, said rotor comprising an annular disc-like member fixedly secured at its one side surface to one end surface of said rotary member and having a first operating surface formed at its other side, and said stator being mounted on said housing and having a second operating surface disposed in an axially face-to-face relation with said first operating surface of said rotor, said first and second operating surfaces being disposed substantially perpendicular to said axis of said rotary shaft.

3. A turbomolecular pump as set forth in claim 2 wherein said upper bearing further comprises a magnetic bearing adapted to magnetically suppress radial oscillations of said rotary shaft.

4. A turbomolecular pump as set forth in claim 1, wherein said magnetic bearing comprises a reaction-type magnetic bearing.

5. A turbomolecular pump comprising:

a cylindrical housing having a plurality of stator vanes provided on the inner peripheral surface thereof, said cylindrical housing having inlet port means and outlet port means;

a rotary shaft supported on said cylindrical housing for rotation about a vertical axis;

an upper bearing and a lower bearing, said lower bearing including a spherical-type, spirally grooved bearing mounted at a lower end wall of said cylindrical housing;

a rotary member fixedly mounted on said rotary shaft and having a plurality of rotor vanes provided on the radially outer peripheral surface thereof, said rotor vanes being interlaced with said stator vanes in face-to-face relation with each other so that during rotation of said rotary member, said rotor and stator vanes cooperate with each other to produce a unidirectional flow of fluid from said inlet port means toward said outlet port means; and an electric motor including a stator and a rotor disposed in said cylindrical housing about said axis and in a position which is radially inward of some of the vanes for electromagnetically driving said rotary member to rotate relative to said housing, said rotor comprising an annular disc-like member fixedly secured at its one side surface to one end surface of said rotary member and having a first operating surface formed at its other side, and said stator being mounted on said housing and having a second operating surface disposed in an axially face-to-face relation with said first operating surface of said rotor, said first and second operating surfaces being disposed substantially perpendicular to said axis of said rotary shaft.

6. A turbomolecular pump as set forth in claim 5 wherein said rotary member has an annular recess formed at one side surface thereof at a location near the center thereof so as to surround said rotary shaft, said motor being disposed in said annular recess.

7. A turbomolecular pump as set forth in claim 6 wherein said housing has an annular projection extending axially inwardly from one end wall of said cylindrical housing in concentric relation with said rotary shaft, said stator of said motor being mounted on said annular projection, said rotary shaft extending from one end surface of said rotary member into a hollow interior of said annular projection.

* * * * *